US012070677B1

(12) United States Patent
Sanchez, Jr.

(10) Patent No.: US 12,070,677 B1
(45) Date of Patent: Aug. 27, 2024

(54) MAGNETIC POOL CUE HOLDER

(71) Applicant: Gilberto Sanchez, Jr., Lancaster, PA (US)

(72) Inventor: Gilberto Sanchez, Jr., Lancaster, PA (US)

( * ) Notice: Subject to any disclaimer, the term of this patent is extended or adjusted under 35 U.S.C. 154(b) by 0 days.

(21) Appl. No.: 18/079,985

(22) Filed: Dec. 13, 2022

(51) Int. Cl.
*A63D 15/00* (2006.01)
*A63D 15/10* (2006.01)

(52) U.S. Cl.
CPC ..... *A63D 15/10* (2013.01); *A63D 15/005* (2013.01)

(58) Field of Classification Search
CPC ..... A47B 81/005; A63D 15/10; A63D 15/005
USPC .... 211/68, 64, DIG. 1, 70.8; 473/44, 21, 40, 473/26, 41; D21/782
See application file for complete search history.

(56) References Cited

U.S. PATENT DOCUMENTS 1,007,414 A * 10/1911 Bass et al. ..... A63D 15/10 211/8
1,167,137 A * 1/1916 Treiber ..... A63D 15/005 473/40
1,240,705 A * 9/1917 Grode ..... A63D 15/10 211/68
1,633,004 A * 6/1927 Demers ..... A63D 15/10 211/68
1,683,533 A * 9/1928 Drost ..... A63D 15/10 211/68
2,385,859 A * 10/1945 Jacobson ..... B26B 21/40 30/296.1
2,642,999 A * 6/1953 McPherson ..... H01F 7/0252 D6/531
3,146,889 A * 9/1964 Franco ..... A63D 15/10 211/68
3,289,990 A * 12/1966 Grantham ..... A47K 1/09 248/908
3,746,177 A * 7/1973 Vilotti ..... F41A 23/18 211/64
3,794,319 A * 2/1974 Miller ..... A63D 15/005 473/41
4,802,580 A * 2/1989 Andersen ..... B25H 3/04 211/DIG. 1
5,046,728 A 9/1991 Haddock
5,064,159 A * 11/1991 Kotick ..... A47G 29/08 248/309.4
5,163,566 A * 11/1992 Hempel ..... A47K 1/09 211/DIG. 1

(Continued)

FOREIGN PATENT DOCUMENTS

WO 2016130957 8/2016

OTHER PUBLICATIONS https://web.archive.org/web/20210225225129/https://billiardsnmore.com/shop/rackr8ck-rkrr-magnetic-rack-holder/ (Year: 2021).*

*Primary Examiner* — Jennifer E. Novosad
(74) *Attorney, Agent, or Firm* — Kyle A. Fletcher, Esq.

(57) ABSTRACT

The magnetic pool cue holder system comprises a pool cue, a rack, and an equipment holder. The pool cue may be adapted to be held by a user and used to strike a cue ball. The pool cue may comprise a cue magnet. The cue magnet may be operable to removably couple the pool cue to the equipment holder. The rack may be configured to place a set of pool balls into starting positions on a pool table. The rack may comprise one or more rack magnets. The one or more rack magnets may be operable to removably couple the rack to the equipment holder.

13 Claims, 7 Drawing Sheets

(56) References Cited

U.S. PATENT DOCUMENTS 5,240,121 A * 8/1993 Mead ..... A63D 15/005 248/176.1
5,328,411 A * 7/1994 Thornton, II ..... A63D 15/16 473/39
5,417,397 A * 5/1995 Harnett ..... A47K 5/05 248/309.4
5,947,583 A * 9/1999 Castano ..... A63D 15/10 362/132
6,092,675 A * 7/2000 Ramirez, Jr. ..... A63D 15/10 473/44
6,102,217 A * 8/2000 Mathy ..... A47B 87/0207 211/90.04
7,484,630 B2 * 2/2009 Rose ..... A47F 7/0028 211/85.7
7,628,706 B2 * 12/2009 Xie ..... B24D 15/00 30/494
7,896,176 B2 * 3/2011 McCormick ..... A47B 81/00 211/85.7
7,997,024 B2 * 8/2011 Gesik ..... A01K 97/06 43/57.1
8,403,278 B1 * 3/2013 Kasbohm ..... F41A 23/18 42/99
8,727,141 B2 * 5/2014 Akalin ..... A46B 17/02 211/DIG. 1
8,734,262 B1 * 5/2014 Yovanovich ..... A63D 15/00 473/41
8,911,299 B1 * 12/2014 Day ..... A63D 15/005 473/40
9,616,319 B2 * 4/2017 Geiges ..... A63D 15/005
10,010,173 B1 * 7/2018 Ricco ..... F42B 6/00
10,245,501 B2 4/2019 Klimeck
10,369,438 B2 8/2019 Orme
10,631,627 B2 * 4/2020 Peters ..... A46B 15/0095
10,716,413 B2 * 7/2020 Winnard ..... F16B 1/00
2003/0000900 A1 * 1/2003 Yu ..... A46B 5/00 15/159.1
2003/0070998 A1 * 4/2003 Bulka ..... A47K 1/09 211/94.01
2006/0186067 A1 * 8/2006 Rose ..... A47F 7/0028 211/68
2007/0066411 A1 * 3/2007 Gulyassy ..... A63D 15/12 473/44
2007/0066412 A1 * 3/2007 Chan ..... A63D 15/12 473/51
2008/0153612 A1 * 6/2008 Bowe ..... A63D 15/08 473/44
2008/0197090 A1 * 8/2008 Goff ..... A63D 15/10 211/68
2009/0078661 A1 * 3/2009 Kinsella ..... A47B 81/005 211/64
2009/0218463 A1 * 9/2009 Winnard ..... B25H 3/04 248/309.4
2012/0043348 A1 * 2/2012 Sunatori ..... B65D 51/242 211/DIG. 1
2015/0052727 A1 * 2/2015 Rosso, Jr. ..... A47B 67/02 29/428
2015/0083680 A1 * 3/2015 Beckerich ..... A63D 15/10 211/85.7
2015/0289646 A1 * 10/2015 Stapp ..... F21V 33/004 211/113
2021/0316204 A1 10/2021 Gomez
2022/0016513 A1 1/2022 Gomez
2022/0258034 A1 8/2022 Webb
2023/0151648 A1 * 5/2023 Abbott ..... E05B 47/004 292/251.5

* cited by examiner

MAGNETIC POOL CUE HOLDER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of cue sports and sporting equipment storage, more specifically, a magnetic pool cue holder system.

Summary of Invention

The magnetic pool cue holder system comprises a pool cue, a rack, and an equipment holder. The pool cue may be adapted to be held by a user and used to strike a cue ball. The pool cue may comprise a cue magnet. The cue magnet may be operable to removably couple the pool cue to the equipment holder. The rack may be configured to place a set of pool balls into starting positions on a pool table. The rack may comprise one or more rack magnets. The one or more rack magnets may be operable to removably couple the rack to the equipment holder.

An object of the invention is to provide a pool cue comprising a cue magnet.

Another object of the invention is to provide a rack comprising one or more rack magnets.

A further object of the invention is to provide an equipment holder comprising at least one ferromagnetic surface to which the pool cue and/or rack may be removably coupled by magnetic attraction.

Yet another object of the invention is to provide wall mounted bar, lighted dual cur holder, chair mounted cue holder, and floor mounted cue holder embodiments of the equipment holder.

These together with additional objects, features and advantages of the magnetic pool cue holder system will be readily apparent to those of ordinary skill in the art upon reading the following detailed description of the presently preferred, but nonetheless illustrative, embodiments when taken in conjunction with the accompanying drawings.

In this respect, before explaining the current embodiments of the magnetic pool cue holder system in detail, it is to be understood that the magnetic pool cue holder system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the magnetic pool cue holder system.

It is therefore important that the claims be regarded as including such equivalent construction insofar as they do not depart from the spirit and scope of the magnetic pool cue holder system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
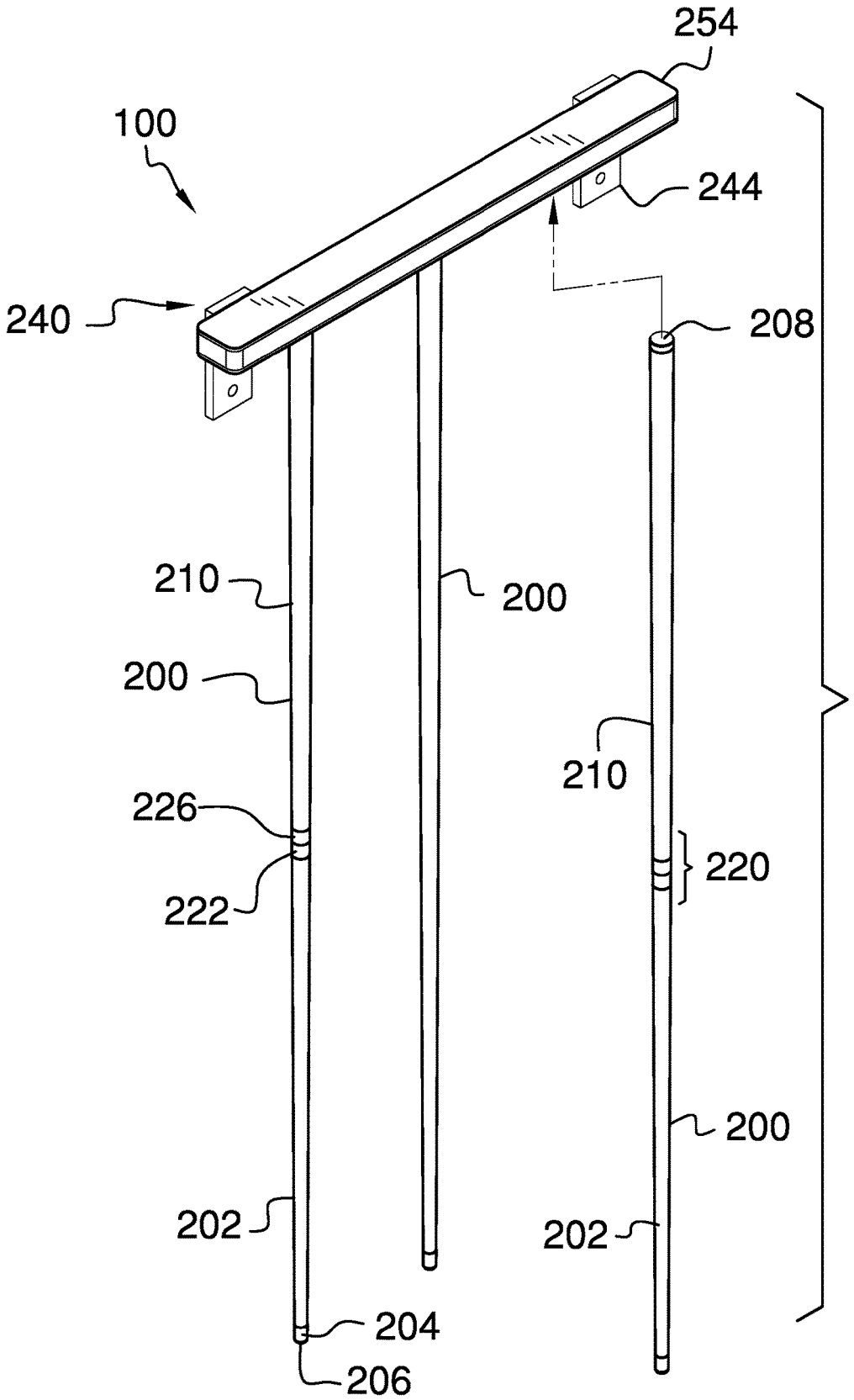
FIG. 1 is an isometric view of an embodiment of the disclosure.
Figure 2:
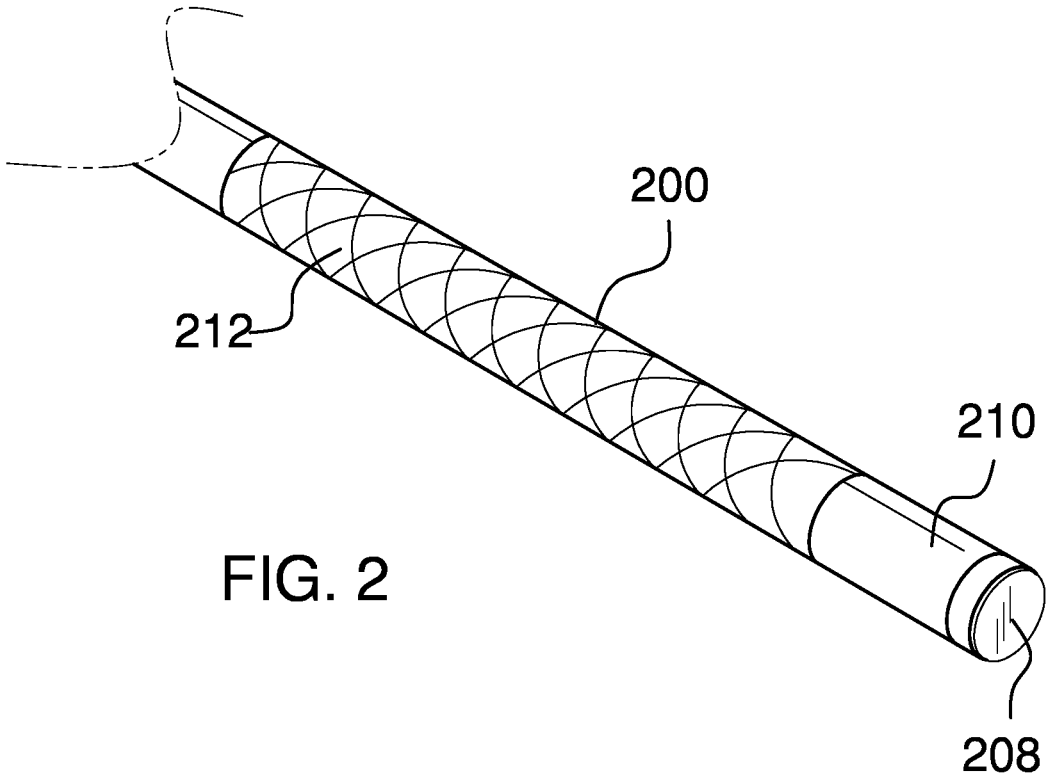
FIG. 2 is a detail view of an embodiment of the disclosure, illustrating the cue magnet.
Figure 3:
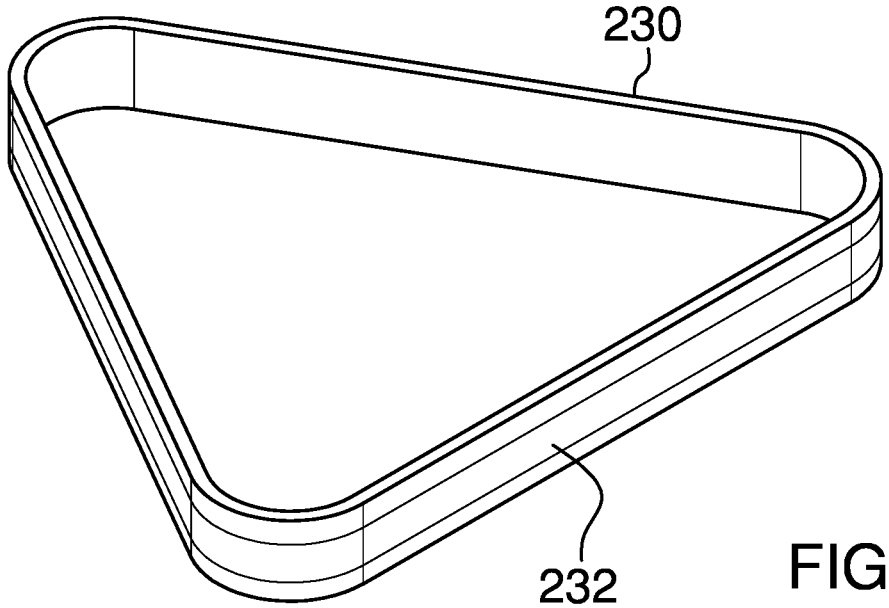
FIG. 3 is a detail view of an embodiment of the disclosure, illustrating the rack and one or more rack magnets.
Figure 4:
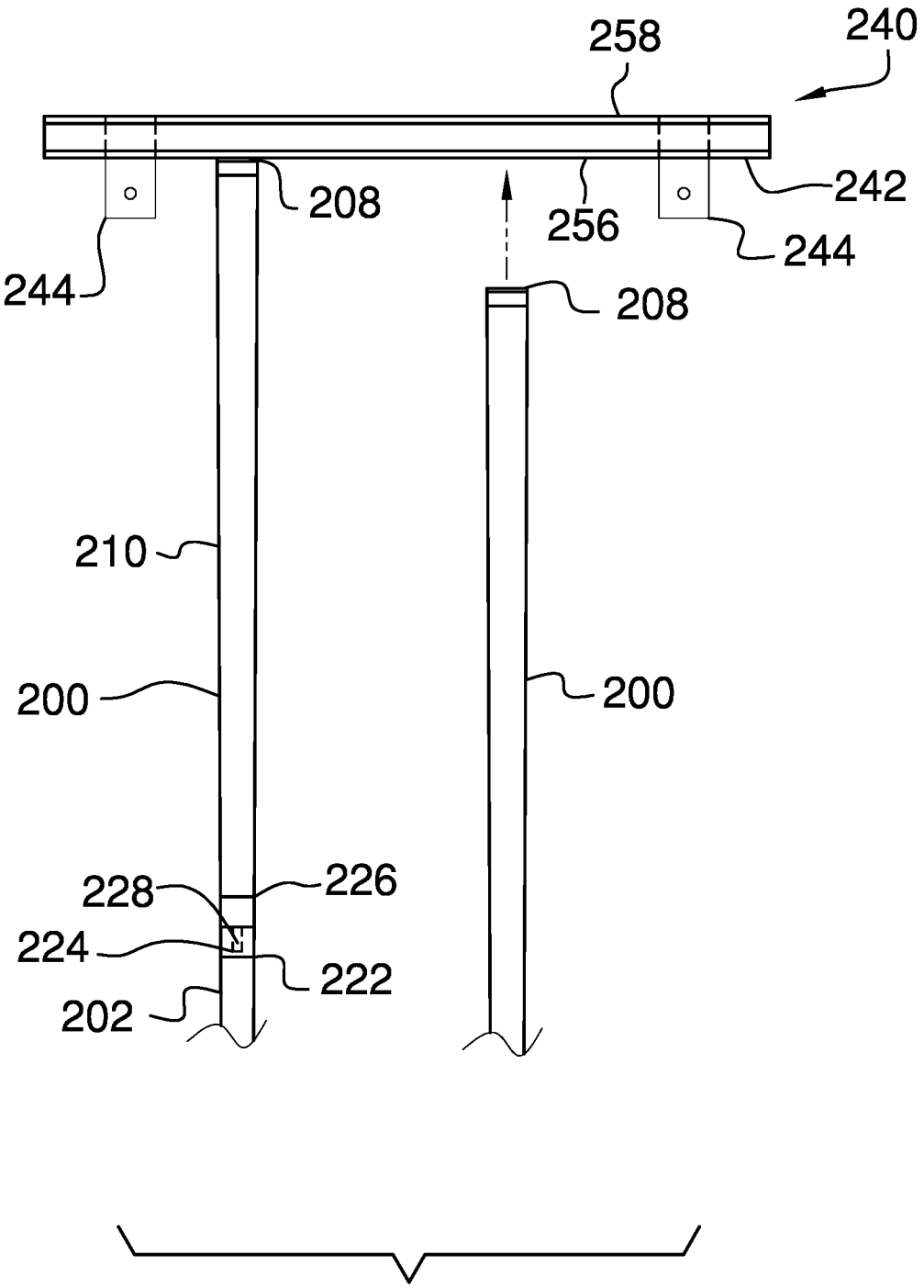
FIG. 4 is a front view of an embodiment of the disclosure.
Figure 5:
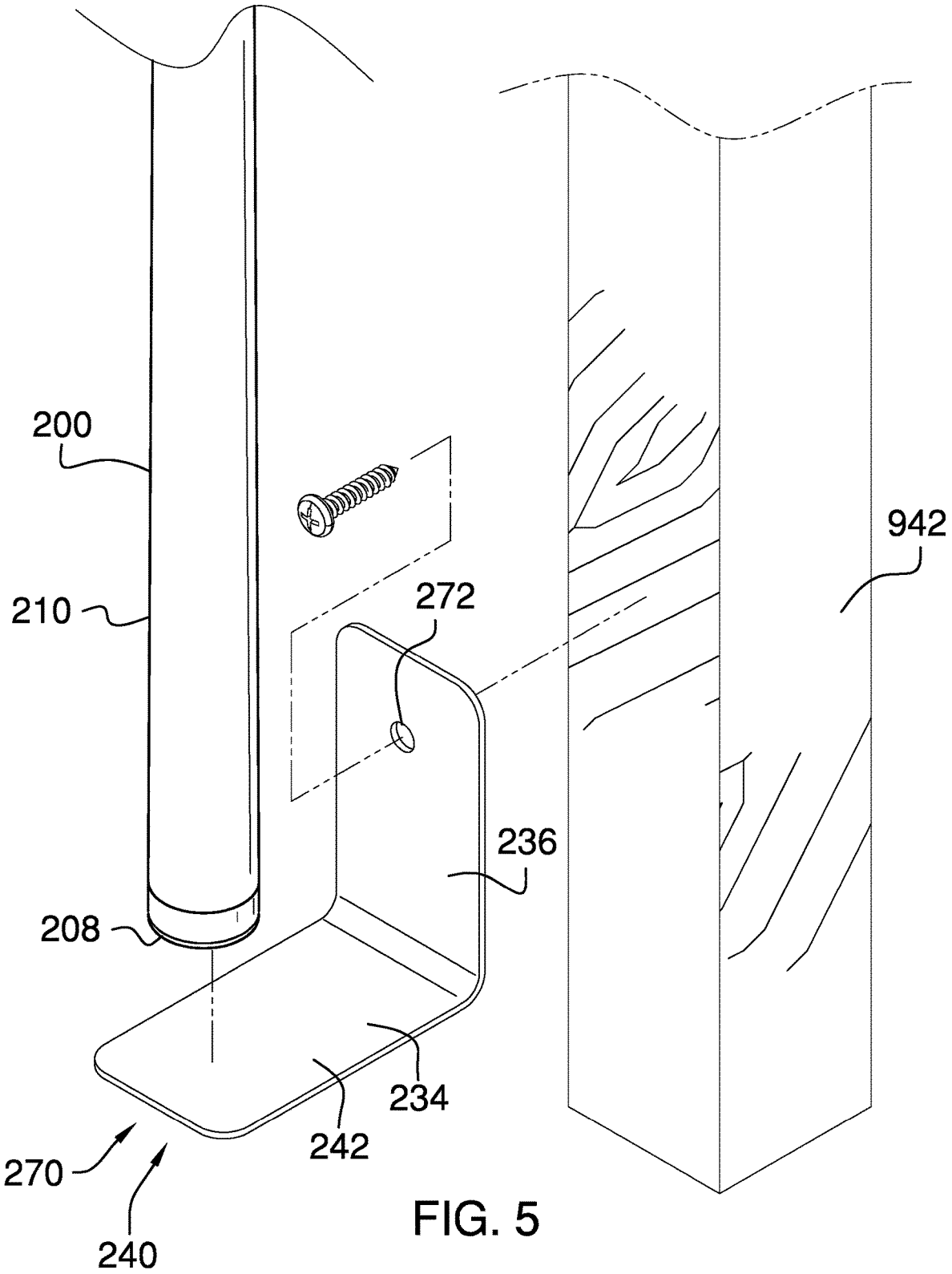
FIG. 5 is a detail view of an embodiment of the disclosure, illustrating the chair mounted cue holder.
Figure 6:
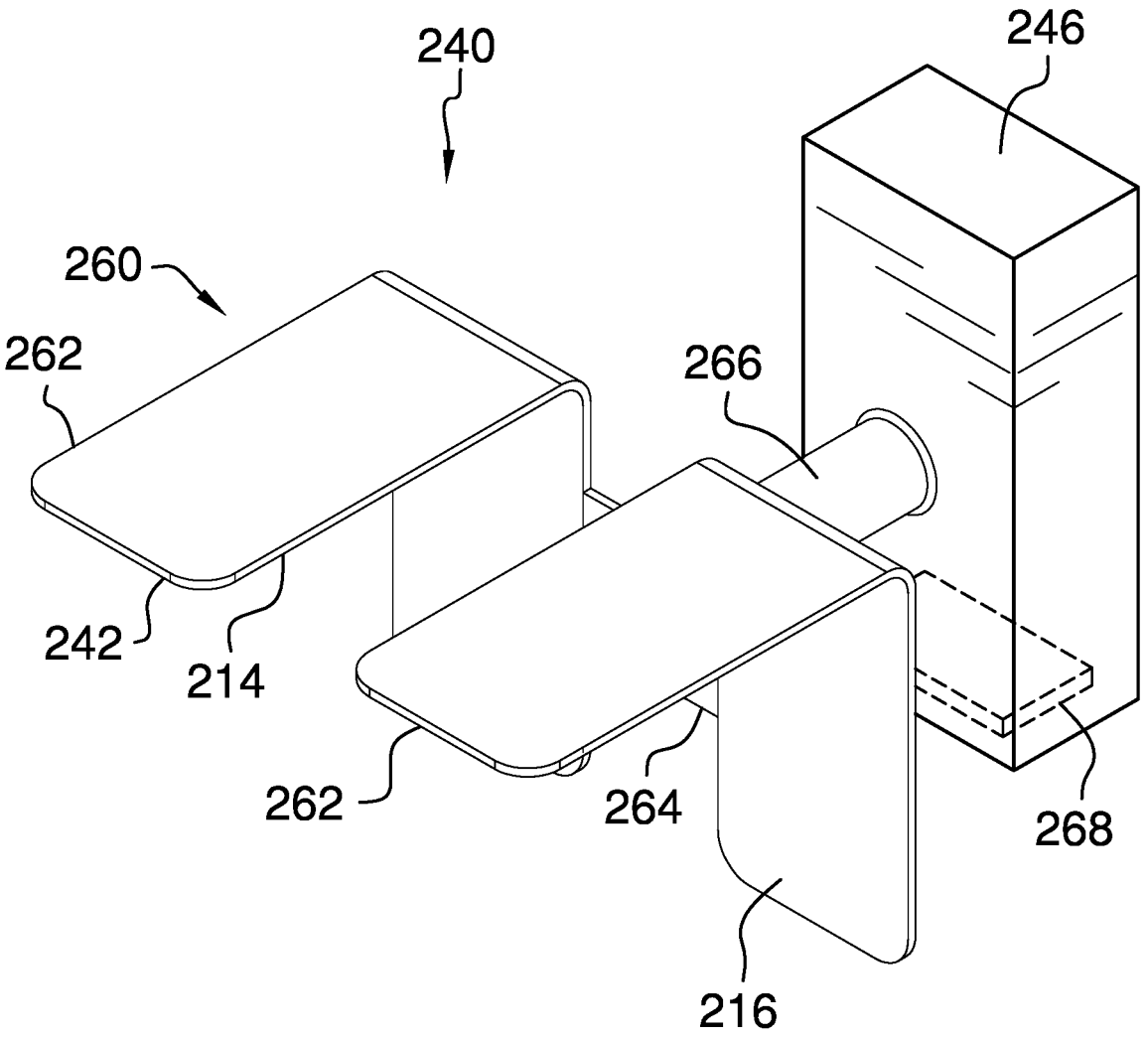
FIG. 6 is a detail view of an embodiment of the disclosure, illustrating the lighted dual cue holder.
Figure 7:
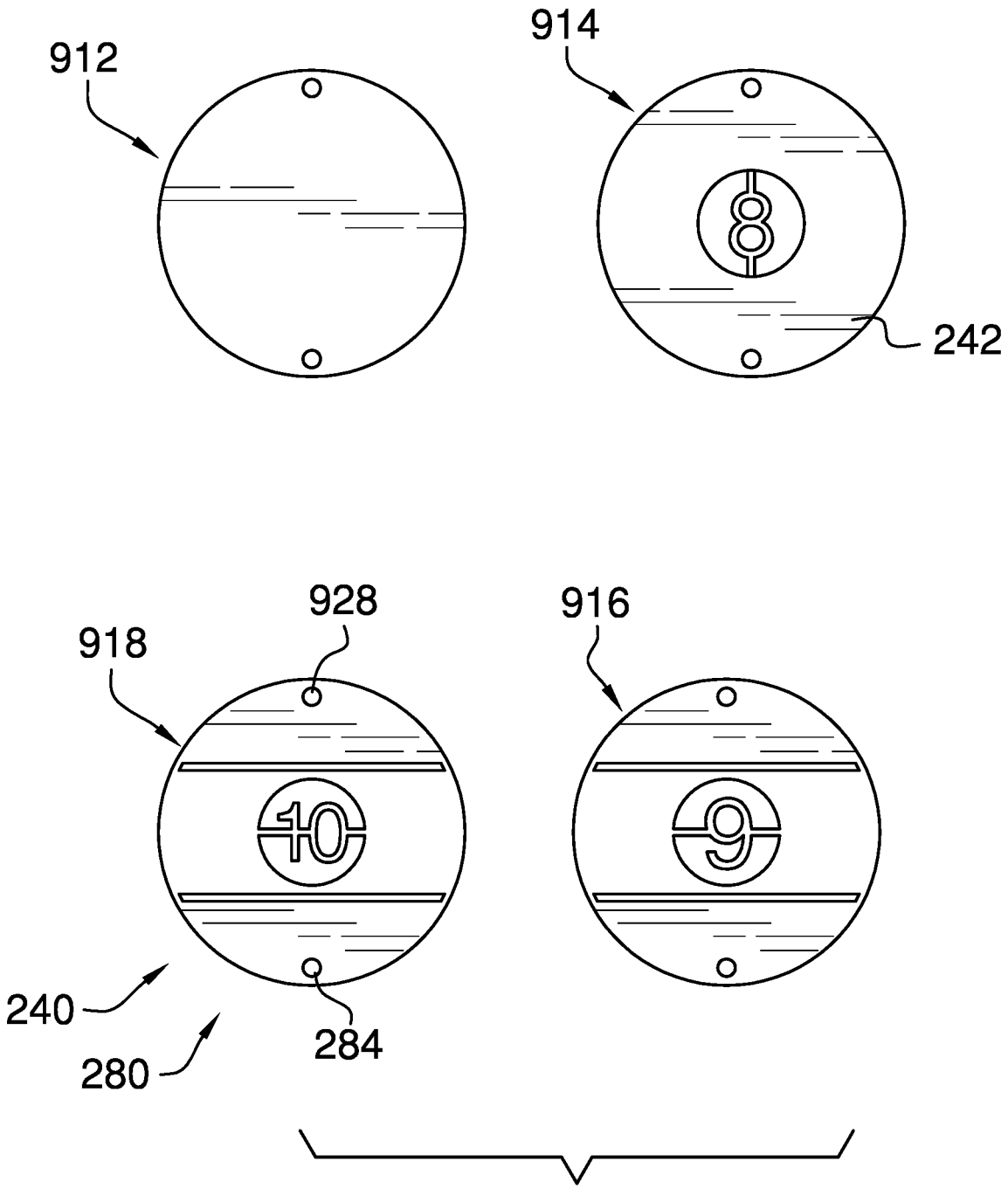
FIG. 7 is a top view of an embodiment of the disclosure, illustrating floor mounted cue holders.
Figure 8:
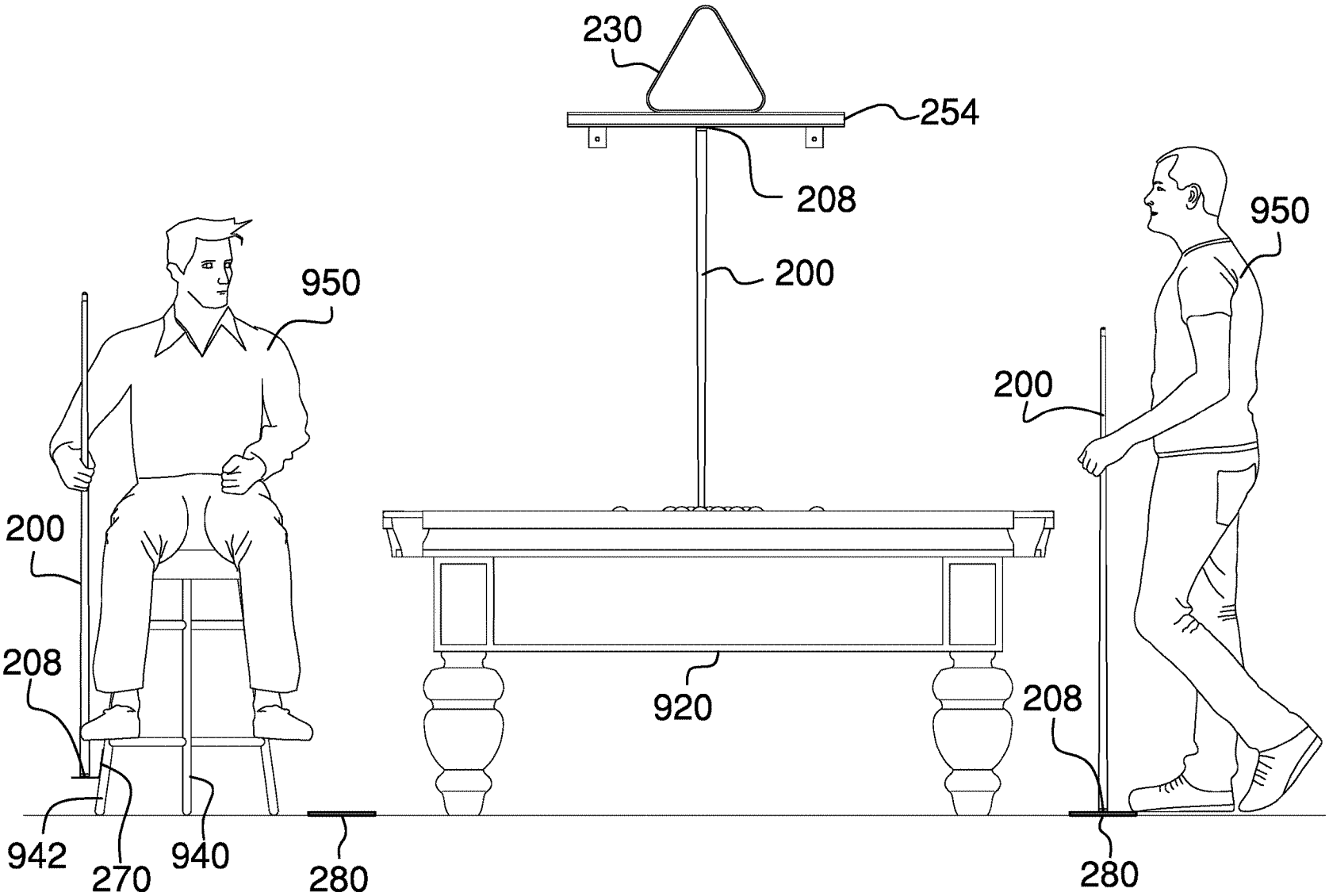
FIG. 8 is an in-use view of an embodiment of the disclosure.

Detailed reference will now be made to a first potential embodiment of the disclosure, which is illustrated in FIGS. 1 through 8.

The magnetic pool cue holder system 100 (hereinafter invention) comprises a pool cue 200, a rack 230, and an equipment holder 240. The pool cue 200 may be adapted to be held by a user 950 and used to strike a cue ball 912. The pool cue 200 may comprise a cue magnet 208. The cue magnet 208 may be operable to removably couple the pool cue 200 to the equipment holder 240. The rack 230 may be configured to place a set of pool balls into starting positions on a pool table 920. The rack 230 may comprise one or more rack magnets 232. The one or more rack magnets 232 may be operable to removably couple the rack 230 to the equipment holder 240.

The pool cue 200 may be a tapered stick used to strike the cue ball 912. The pool cue 200 may comprise a ferrule 204 located at the distal end of the pool cue 200. A tip 206 may couple to the ferrule 204. The tip 206 may transfer the energy of the strike to the cue ball 912. As non-limiting examples, the tip 206 may be made from leather, phenolics, carbon fiber, or any combination thereof.

In some embodiments, the pool cue 200 may comprise a shaft 202, a butt 210 and a joint 220. The shaft 202 may be the distal portion of the pool cue 200. The butt 210 may be the proximal portion of the pool cue 200. The shaft 202 may couple to the butt 210 via the joint 220. The butt 210 may comprise a wrap 212. The wrap 212 may encircle the butt 210. The wrap 212 may be adapted to be gripped by the user 950 while striking the cue ball 912. As non-limiting examples, the wrap 212 may be made of rubber or leather.

The joint 220 may enable the shaft 202 and the butt 210 to be separated for transport and/or storage and coupled in order to use the pool cue 200. The joint 220 may comprise a shaft collar 222 coupled to the proximal end of the shaft 202 and a butt collar 226 couple to the distal end of the butt 210. The shaft collar 222 may engage the butt collar 226 in order to form the pool cue 200. As a non-limiting example, the butt collar 226 may comprise a joint pin 228 that may be threaded and the shaft collar 222 may comprise a shaft collar aperture 224 that may be threaded to be complementary to the threading of the joint pin 228. The joint 220 may retain the shaft 202 and the butt 210 by screwing the joint pin 228 into the shaft collar aperture 224.

In some embodiments, the pool cue 200 may be made of wood. As non-limiting examples, the pool cue 200 may be made of maple, ash, or combinations thereof.

The cue magnet 208 may be located at the proximal end of the pool cue 200. The cue magnet 208 may be operable to hold the pool cue 200 on the equipment holder 240. In some embodiments, the cue magnet 208 may be a rare-earth magnet.

The rack 230 may be a triangular armature used to position the set of pool balls on the pool table 920. The rack 230 may comprise the one or more rack magnets 232 located on the outside sidewalls of the rack 230. The one or more rack magnets 232 may be operable to retain the rack 230 on the equipment holder 240.

The equipment holder 240 may be operable to hold one or more of the pool cues 200, the rack 230, or combinations thereof. The equipment holder 240 may comprise at least one ferromagnetic surface 242. The cue magnet 208 of the pool cue 200 and/or the one or more rack magnets 232 of the rack 230 may be placed in contact with the at least one ferromagnetic surface 242 of the equipment holder 240 in order to retain the pool cue 200 and/or the rack 230. The at least one ferromagnetic surface 242 may be made of a ferromagnetic material. As non-limiting examples, the ferromagnetic material may be iron, nickel, cobalt, or any combination thereof.

In some embodiments, the equipment holder 240 may be a wall mounted bar 254. The wall mounted bar 254 may be horizontally oriented and may comprise a bottom ferromagnetic surface 256 and a top ferromagnetic surface 258. One or more of the pool cues 200 may be suspended beneath the wall mounted bar 254 by magnetic attraction between the cue magnets 208 and the bottom ferromagnetic surface 256. At least one of the racks 230 may be retained on top of the wall mounted bar 254 by magnetic attraction between the one or more rack magnets 232 and the top ferromagnetic surface 258. The wall mounted bar 254 may comprise one or more mounting brackets 244 for mounting the wall mounted bar 254 on a wall.

In some embodiments, the equipment holder 240 may be a lighted dual cue holder 260. The lighted dual cue holder 260 may comprise a pair of cue holders 262, a separation armature 264, a standoff post 266, a wall mount 246, and a light 268. The pair of cue holders 262 may be an inverted L-shaped armatures each comprising a cue holder horizontal surface 214 and a cue holder vertical surface 216. At least the cue holder horizontal surface 214 may be made of the ferromagnetic material such that the pool cues 200 may be suspended beneath the pair of cue holders 262 by magnetic attraction between the cue magnet 208 and the cue holder horizontal surface 214. The pair of cue holders 262 may be separated and held parallel to each other by the separation armature 264 which may be oriented to be horizontal and parallel to the wall. The separation armature 264 may be coupled to the cue holder vertical surfaces 216 of the pair of cue holders 262. The separation armature 264 may be held away from the wall by the standoff post 266 that may be coupled between the separation armature 264 and the wall mount 246. The wall mount 246 may be coupled to the wall. The light 268 may be located within the bottom of the wall mount 246 such that the light 268 may shine down from the wall mount 246 when illuminated.

In some embodiments, the equipment holder 240 may be a chair mounted cue holder 270. The chair mounted cue holder 270 may be an L-shaped chair armature comprising a chair holder horizontal surface 234 and a chair holder vertical surface 236. At least the chair holder horizontal surface 234 may be made of the ferromagnetic material such that the pool cue 200 may be retained above the chair mounted cue holder 270 by magnetic attraction between the cue magnet 208 and the chair holder horizontal surface 234. The chair holder vertical surface 236 may be coupled to a leg 942 of a chair 940 by mounting hardware passing through a chair mounting aperture 272 on the chair holder vertical surface 236 and into the leg 942 of the chair 940.

In some embodiments, the equipment holder 240 may be a floor mounted cue holder 280. The floor mounted cue holder 280 may be a round plate that may fasten to a floor via a pair of floor mounting apertures 284 and mounting hardware. The floor mounted cue holder 280 may be made of the ferromagnetic material such that the pool cue 200 may be retained above the floor mounted cue holder 280 by magnetic attraction between the cue magnet 208 and the floor mounted cue holder 280. The floor mounted cue holders 280 may comprise a plurality of patterns such that each of the floor mounted cue holders 280 resembles an individual pool ball. The plurality of patterns may be formed by stamping, engraving, etching, laser marking, painting, or any combination thereof. As non-limiting examples, the floor mounted cue holder 280 may represent a low ball 916 as a number from 1 to 7 within a circle, a high ball 918 as a number from 9 to 15 within a circle between stripes, an eight ball 914 as the number 8 within a circle, and the cue ball 912 as a featureless circular disk.

In some embodiments, the floor mounted cue holders 280 may comprise 16 of the floor mounted cue holders 280 representing the set of pool balls in its entirety. In some embodiments, the floor mounted cue holders 280 may comprise a subset of the set of pool balls. As a non-limiting example, the subset of the set of pool balls may comprise the cue ball 912, the eight ball 914, the low ball 916, and the high ball 918.

In use, one or more equipment holders 240 may be mounted in the proximity of a pool table 920 and used to hold pool cues 200 and a rack 230. As non-limiting examples, the equipment holders 240 may be wall mounted bars 254, lighted dual cue holders 260, chair mounted cue holders 270, floor mounted cue holders 280, or any combination thereof. The pool cues 200 may be suspended from the bottom of the wall mounted bar 254 and the rack 230 may be retained on top of the wall mounted bar 254. Up to two of the pool cues 200 may be suspended from the lighted dual cue holder 260. In addition, the light 268 built into the bottom of the lighted dual cue holder 260 may provide illumination. The pool cue 200 may be made to stand upright on the chair mounted cue holder 270 and/or the floor mounted cue holder 280.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "aperture" may be an opening in a surface or object. Aperture may be synonymous with hole, slit, crack, gap, slot, or opening.

As used in this disclosure, a "collar" may be a ring like device that is placed around an object.

As used herein, "complement" or "complementary" may refer to a compatibility between threaded parts such that the gender, handedness, form, angle, pitch, diameter, and thread depth of both threads are compatible for the parts to mate by screwing the threads together. "Complement" and "complementary" may also be used to describe compatibility between geared parts and/or combinations of geared parts and threaded parts. As a non-limiting example, the worm screw and worm gear of a worm drive mechanism may be said to be complementary if the worm screw meshes with the worm gear and the worm screw is operable to turn the worm gear when the worm screw rotates.

As used herein, the words "couple", "couples", "coupled" or "coupling", may refer to connecting, either directly or indirectly, and does not necessarily imply a mechanical connection.

As used here, "cue" or "cue stick" may refer to a tapered stick used to strike a cue ball in the games of pool, billiards, and snookers. A cue stick may also be known as a pool cue, billiards cue, or snookers cue.

As used in this disclosure, the terms "distal" and "proximal" may be used to describe relative positions. Distal refers to the object, or the end of an object, that is situated away from the point of origin, point of reference, or point of attachment. Proximal refers to an object, or end of an object, that is situated towards the point of origin, point of reference, or point of attachment. Distal implies 'farther away from' and proximal implies 'closer to'. In some instances, the point of attachment may be the where an operator or user of the object makes contact with the object. In some instances, the point of origin or point of reference may be a center point, a central axis, or a centerline of an object and the direction of comparison may be in a radial or lateral direction.

As used in this disclosure, a "ferromagnetic material" may be a material that is attracted to a magnet.

As used in this disclosure, "horizontal" may be a directional term that refers to a direction that is perpendicular to the local force of gravity. Unless specifically noted in this disclosure, the horizontal direction is always perpendicular to the vertical direction.

As used herein, the words "invert", "inverted", or "inversion" may refer to an object that has been turned inside out or upside down or to the act of turning an object inside out or upside down.

As used in this disclosure, a "magnet" may be an ore, alloy, or other material that has its component atoms arranged so that the material exhibits properties of magnetism such as attracting iron-containing objects or aligning itself in an external magnetic field.

As used herein, "mounting hardware" may refer to mechanical devices that are used to attach one object to another, including devices whose only purpose is to improve aesthetics. As non-limiting examples, mounting hardware may comprise screws, nuts, bolts, washers, rivets, crossbars, hooks, collars, nipples, cams, standoffs, knobs, caps, plates, rails, lips, brackets, or any combination thereof.

As used herein, "rare earth" may refer to a group of elements on the periodic table. Rare earth elements may comprise the lanthanides plus yttrium and scandium. Some rare earth elements, such as neodymium and samarium, are notable for their ability to form strong permanent magnets when compounded with transition metals such as iron, nickel, and cobalt.

As used herein, "rare-earth magnet" may refer to a permanent magnet made from alloys of rare-earth (lanthanide) elements. Rare-earth magnets may produce magnetic fields that are 2 to 3 times stronger than ferrite or alnico magnets. Examples of rear-earth magnets include, but are not limited to, neodymium magnets and samarium-cobalt magnets.

As used herein, "subset" may refer to a relationship between two sets. Set 'A' may be said to be a subset of set 'B' if all elements of set 'A' are also elements of set 'B'. The definition of subset allows that the membership of set 'A' may equal the membership of set 'B'. A subset may also be an empty set, meaning that the subset may have no members.

As used herein, "taper" may refer to a continuous and typically, but not necessarily, gradual change in the span of a one or more dimensions of an elongated object that occurs in the apparent direction of elongation. An object that narrows along an axis may be called tapered.

As used in this disclosure, "vertical" may refer to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 8, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claimed is:

1. A magnetic pool cue holder system comprising:

a pool cue, a rack, and an equipment holder adapted to be attached to an external surface;

wherein the pool cue is adapted to be held by a user and used to strike a cue ball;

wherein the pool cue comprises a cue magnet;

wherein the cue magnet is operable to removably couple the pool cue to the equipment holder;

wherein the rack is configured to place a set of pool balls into starting positions on a pool table;

wherein the rack comprises one or more rack magnets;

wherein the one or more rack magnets are operable to removably couple the rack to the equipment holder;

wherein the cue magnet is located at the proximal end of the pool cue;

wherein the cue magnet is operable to hold the pool cue on the equipment holder;

wherein the equipment holder is operable to hold one or more of the pool cues, the rack, or combinations thereof.

2. The magnetic pool cue holder system according to claim 1 wherein the pool cue is a tapered stick used to strike the cue ball.

3. The magnetic pool cue holder system according to claim 2 wherein the pool cue comprises a ferrule located at the distal end of the pool cue;

wherein a tip couples to the ferrule.

4. The magnetic pool cue holder system according to claim 3 wherein the tip is made from leather, phenolics, carbon fiber, or any combination thereof.

5. The magnetic pool cue holder system according to claim 3 wherein the pool cue comprises a shaft, a butt and a joint;

wherein the shaft is the distal portion of the pool cue;

wherein the butt is the proximal portion of the pool cue;

wherein the shaft couples to the butt via the joint;

wherein the butt comprises a wrap;

wherein the wrap encircles the butt;

wherein the wrap is adapted to be gripped by the user while striking the cue ball.

6. The magnetic pool cue holder system according to claim 5 wherein the wrap is made of rubber or leather.

7. The magnetic pool cue holder system according to claim 5 wherein the joint enables the shaft and the butt to be separated for transport and/or storage and coupled in order to use the pool cue;

wherein the joint comprises a shaft collar coupled to the proximal end of the shaft and a butt collar coupled to the distal end of the butt;

wherein the shaft collar engages the butt collar in order to form the pool cue.

8. The magnetic pool cue holder system according to claim 7 wherein the butt collar comprises a joint pin that is threaded and the shaft collar comprises a shaft collar aperture that is threaded to be complementary to the threading of the joint pin;

wherein the joint retains the shaft and the butt by screwing the joint pin into the shaft collar aperture.

9. The magnetic pool cue holder system according to claim 3 wherein the cue magnet is a rare-earth magnet.

10. The magnetic pool cue holder system according to claim 3 wherein the rack is a triangular armature used to position the set of pool balls on the pool table;

wherein the rack comprises the one or more rack magnets located on the outside sidewalls of the rack;

wherein the one or more rack magnets are operable to retain the rack on the equipment holder.

11. The magnetic pool cue holder system according to claim 10 wherein the equipment holder comprises at least one ferromagnetic surface;

wherein the cue magnet of the pool cue and/or the one or more rack magnets of the rack are placed in contact with the at least one ferromagnetic surface of the equipment holder in order to retain the pool cue and/or the rack;

wherein the at least one ferromagnetic surface is made of a ferromagnetic material.

12. The magnetic pool cue holder system according to claim 11 wherein the ferromagnetic material is iron, nickel, cobalt, or any combination thereof.

13. The magnetic pool cue holder system according to claim 11 wherein the equipment holder is a wall mounted bar;

wherein the wall mounted bar is horizontally oriented and comprises a bottom ferromagnetic surface and a top ferromagnetic surface;

wherein one or more of the pool cues are suspended beneath the wall mounted bar by magnetic attraction between the cue magnets and the bottom ferromagnetic surface;

wherein at least one of the racks are retained on top of the wall mounted bar by magnetic attraction between the one or more rack magnets and the top ferromagnetic surface;

wherein the wall mounted bar comprises one or more mounting brackets for mounting the wall mounted bar on a wall.

* * * * *